US006089941A

United States Patent [19]

Glickman et al.

[11] Patent Number: 6,089,941

[45] **Date of Patent: *Jul. 18, 2000**

[54] PANELS FOR CONSTRUCTION TOY SET

[75] Inventors: Joel I. Glickman, Huntingdon Valley; Rachele Carlson, Lansdale; Mark McCormick, Hatfield; John Zimmer, Lansdale, all of Pa.

[73] Assignee: Connector Set Limited Partnership, Hatfield, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,709

[22] Filed: Oct. 3, 1997

[51] Int. Cl.[7] ..... A63H 33/04

[52] U.S. Cl. ..... 446/111; 446/108; 446/126; 446/120

[58] Field of Search ..... 446/108, 111, 446/112, 113, 114, 115, 116, 126, 120

[56] References Cited

U.S. PATENT DOCUMENTS

| | | | |
|---|---|---|---|
| D. 296,344 | 6/1988 | Olsen . | |
| D. 297,303 | 8/1988 | Finklestein . | |
| D. 304,214 | 10/1989 | Buist . | |
| D. 308,705 | 6/1990 | Olsen . | |
| D. 332,640 | 1/1993 | Pagel . | |
| 2,799,118 | 7/1957 | Lullo . | |
| 2,972,833 | 2/1961 | La Grutta . | |
| 3,177,611 | 4/1965 | Beck . | |
| 3,546,807 | 12/1970 | Howe . | |
| 3,827,177 | 8/1974 | Wengel . | |
| 3,855,748 | 12/1974 | Thomas . | |
| 3,927,489 | 12/1975 | Bernstein | 446/126 |
| 4,129,975 | 12/1978 | Gabriel . | |
| 4,253,268 | 3/1981 | Mayr . | |
| 4,571,200 | 2/1986 | Serna . | |
| 4,787,191 | 11/1988 | Shima . | |
| 5,046,982 | 9/1991 | Erickson . | |
| 5,100,358 | 3/1992 | Volgger . | |
| 5,137,485 | 8/1992 | Penner . | |
| 5,183,430 | 2/1993 | Swann | 446/111 |
| 5,199,919 | 4/1993 | Glickman . | |
| 5,575,701 | 11/1996 | Hantman . | |

FOREIGN PATENT DOCUMENTS

| | | | |
|---|---|---|---|
| 1281767 | 12/1961 | France | 446/126 |
| 2040701 | 9/1980 | United Kingdom | 446/111 |

*Primary Examiner*—Robert A. Hafer
*Assistant Examiner*—Jeffrey D. Carlson
*Attorney, Agent, or Firm*—Schweitzer Cornman Gross & Bondell LLP

[57] ABSTRACT

A panel, formed of molded plastic material in a variety of polygonal geometric configurations, for incorporation into structures built with K'NEX construction toy sets. The panels include elements, typically formed at corners thereof, corresponding in size and shape to rod elements of the construction set and adapted for lateral snap-in assembly with connector elements of the toy set. At least one pair of corner elements is aligned along a common axis and the end-to-end distance between the elements of such pair corresponds with the length of a standard rod element in the construction set so as to be capable of substitution for a rod element in a structure of K'NEX components. The panels serve both aesthetic and structural functions in the assembly.

13 Claims, 8 Drawing Sheets

FIG. 1
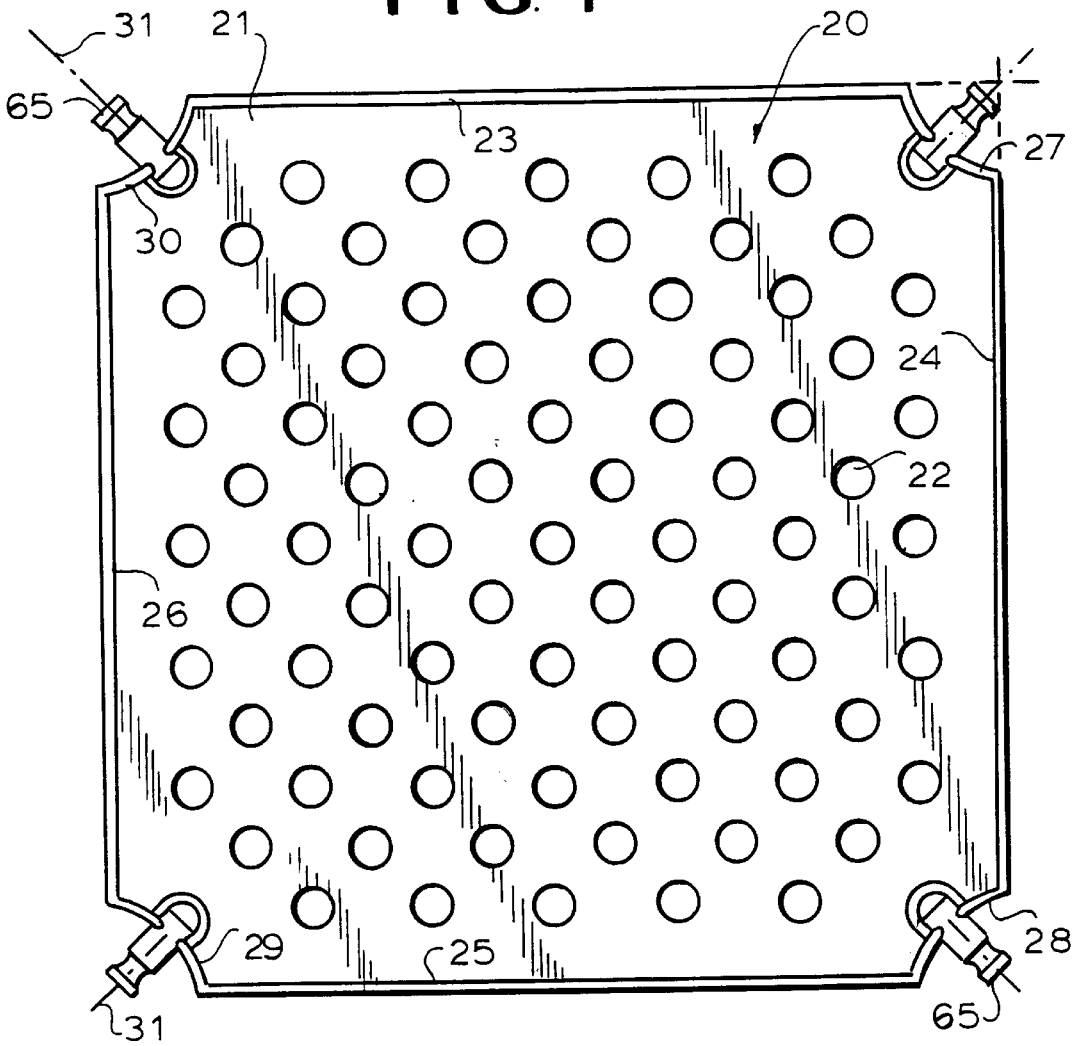
FIG. 2
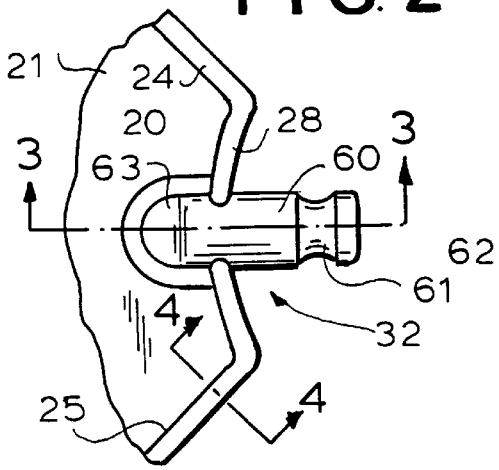
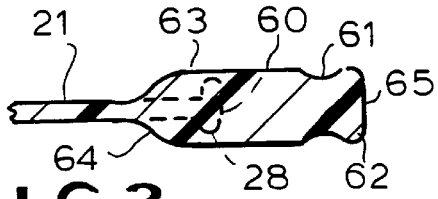
FIG. 3
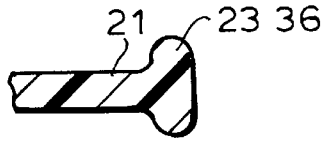
FIG. 4

FIG. 5
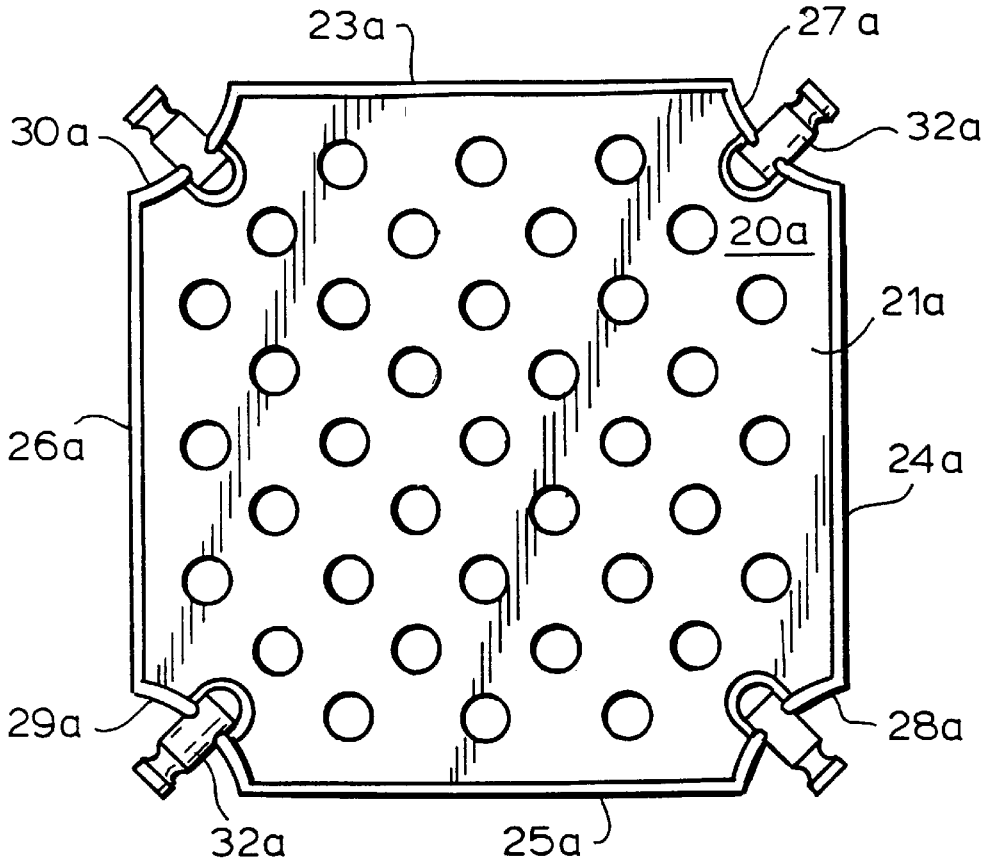
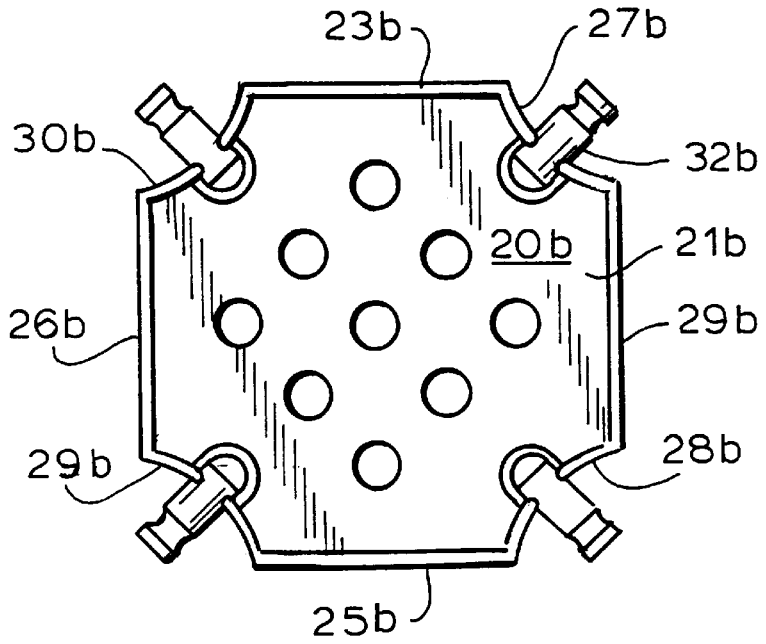
FIG. 6

FIG. 10
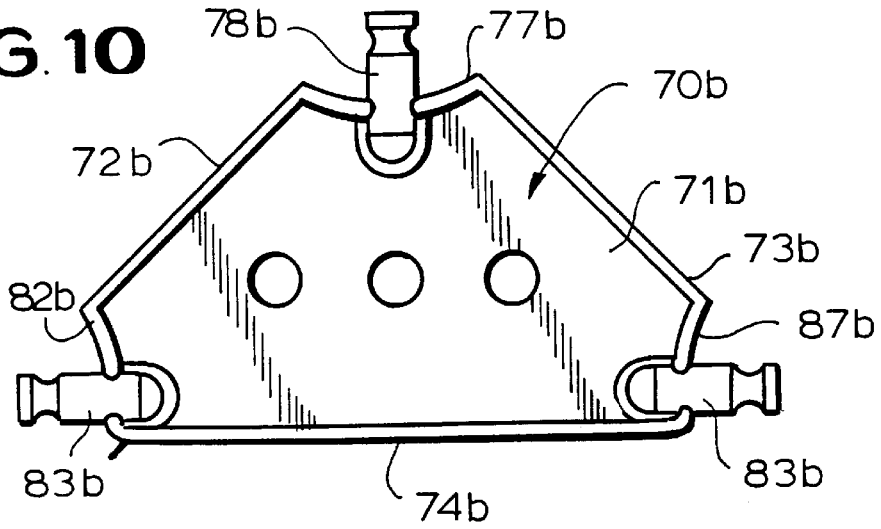
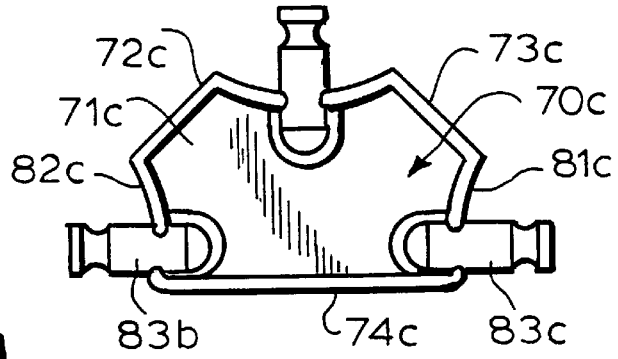
FIG. 11
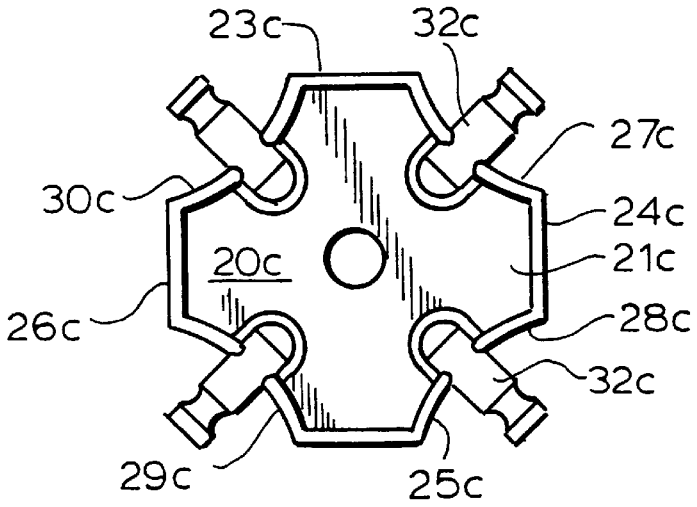
FIG. 7

FIG. 12
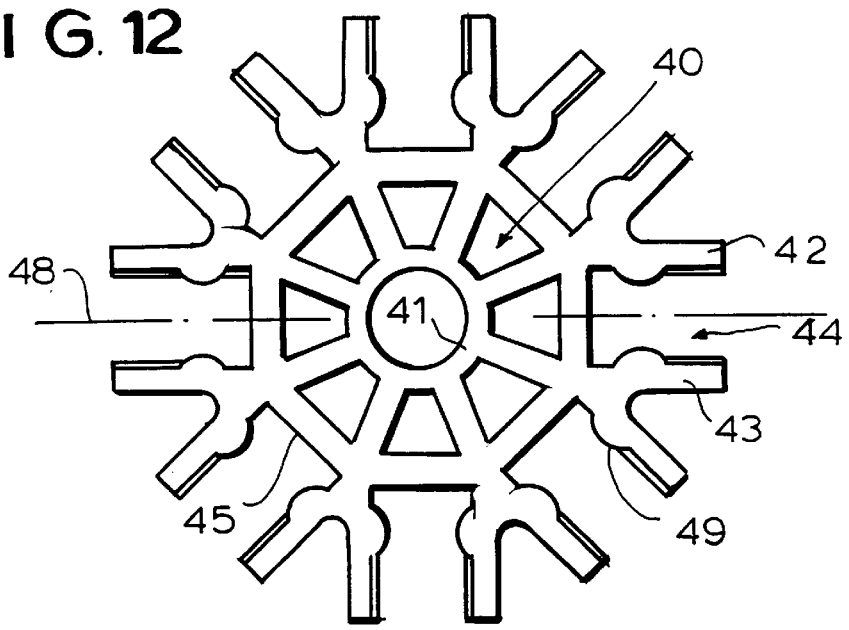
FIG. 13
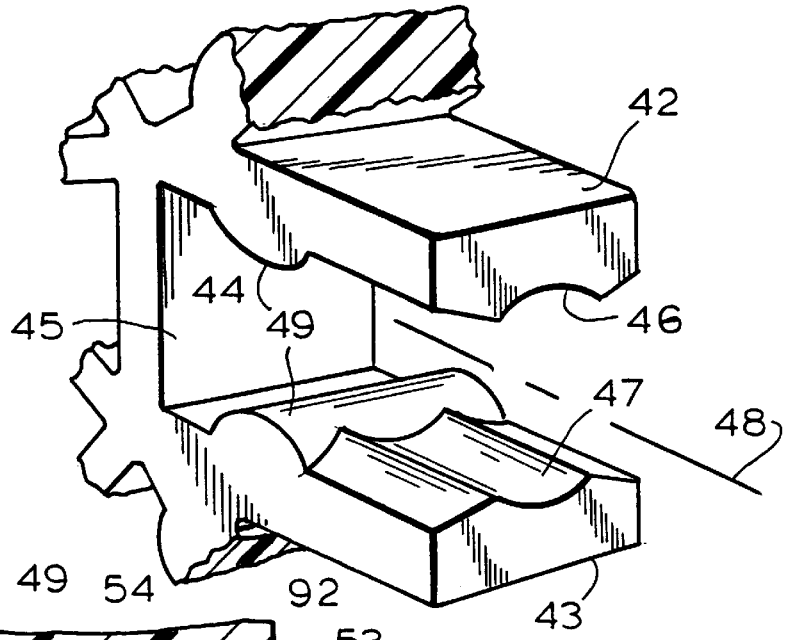
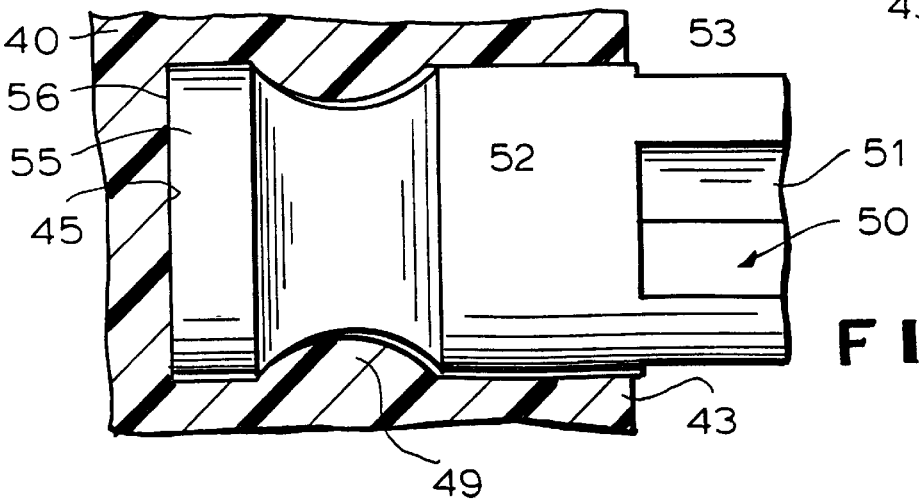
FIG. 14

PANELS FOR CONSTRUCTION TOY SET

RELATED SUBJECT MATTER

This invention is related to the subject matter of U.S. Pat. Nos. 5,061,219, 5,137,486, 5,199,919 and 5,350,331 directed to a construction toy product marketed under the trademark "K'NEX". The disclosures of these before mentioned United States patents is incorporated herein by reference.

BACKGROUND AND SUMMARY OF THE INVENTION

A construction toy product incorporating principles of the above mentioned United States patents and widely marketed under the trademark "K'NEX", is comprised of a plurality of molded plastic connectors which can be assembled with molded plastic rod elements of graduated lengths to form complex, coherent skeletal structures. The connector elements are of special design, comprising one or more pairs of cantilever-mounted gripping arms oriented along radial axes extending from a defined common point of the connector. Opposed pairs of the gripping arms form sockets for the lateral, snap-fit reception of end portions of the rod elements. Outer portions of the gripping arms are formed with axially extending grooves arranged to grip cylindrical portions of the rod elements. Each pair of the gripping arms is also provided with opposed, transversely disposed ribs, and these ribs cooperate with annular grooves formed in the rod elements, closely adjacent their ends.

When a rod element is laterally snap-fit assembled with a connector, the grooved outer portions of a pair of gripping arms engage and grip the cylindrical end portion of the rod element and hold it in alignment with the axis of the socket. The opposed ribs of the gripping arms are received within the annular groove adjacent the rod end and serve to prevent axial movement of the rod. The ability of the rod elements to be assembled with the connectors by lateral snap-fit motion permits the assembly of rod elements with an opposed pair of connectors at each end, without requiring the connectors to be separated to accommodate the assembly, and thus accommodates the assembly of large and complex skeletal structures.

The present invention is directed to a novel and advantageous design and construction of panel elements which are adapted to be incorporated into a skeletal structure of the type described above in a manner to allow enclosure or partial enclosure of skeletal structures and at the same time forming an integral part of and thus enhancing such structures. To this end, panel elements according to the invention are formed of an injection molded structural plastic material and include a thin, flat central area bounded by side edges. The panels may take a variety of polygonal shapes, most typically in the form of a square or a right isosceles triangle. Adjacent panel side edges define corner regions of the panels, and at each such corner region there is formed an integrally molded rod tip element which projects outward from the corner region and has an axis aligned substantially in the plane of the panel. Each of these rod tip elements has a configuration corresponding to the end configuration of the before described rod elements, being thus adapted for lateral snap-fit assembly between an opposed pair of gripping arms of a connector element. Preferably, at least certain of the integral rod tip elements are arranged in aligned pairs, spaced apart a predetermined distance corresponding to the length of a rod element of the construction toy set. In this respect, in the described construction toy set, rod elements are provided in a predetermined graduated series of lengths and for each size and shape of panel according to the invention, at least opposed integral rod tip elements of at least one pair thereof are spaced apart according to the length of a rod of the graduated series thereof.

In one preferred form of the invention, panel elements are of square configuration, formed with opposed pairs of integral rod tip elements aligned with diagonals of the square. In another advantageous form of the invention, the panel may be of triangular configuration and opposed pair of rod ends are aligned along one side edge of the panel, forming the base of a right isosceles triangle. A third integral rod tip element is formed at the apex of the triangle, bisecting the angle of the apex.

To advantage, the side edges of the panel elements are generally straight. Each corner region of the panel is defined by a corner edge having concave arcuate contours joining adjacent side edge portions, and the integral rod tip elements project outward from the concavely contoured corner areas. In a particularly preferred form, the outer ends of the rod tip elements are confined substantially to an area defined by said concave edge contours and by intersecting extensions of adjacent side edges of the panel.

The panel elements of the invention can be readily incorporated in and/or removed from existing complex skeletal structures without the necessity of distorting the structure. When assembled, the panels are an integral part of the structure and can be utilized both in conjunction with and, in some cases, in place of the usual rod elements.

For a more complete understanding of the above and other features and advantages of the invention, reference should be made to the following detailed description of preferred embodiments and to the accompanying drawings.

DESCRIPTION OF THE DRAWINGS

FIG. 1 is a plan view of a rectangular panel according to the invention.

FIG. 2 is an enlarged, fragmentary view showing details of construction of a corner region of the panel of FIG. 1.

FIGS. 3 and 4 are fragmentary cross sectional views as taken generally on lines 3—3, 4—4 respectively of FIG. 2.

FIGS. 5, 6 and 7 are plan views of rectangular panels similar to but of smaller size than the panel of FIG. 1.

FIGS. 10 and 11 are plan views of triangular panels, similar to that of FIG. 7, but of smaller size.

FIG. 12 is a plan view of a connector element according to features of the before mentioned United States patents.

FIG. 13 is an enlarged, fragmentary perspective illustration showing details of a gripping socket of the connector of FIG. 12.

FIG. 14 is an illustration of a connector socket assembled with a rod element, as set forth in the before mentioned United States patents.

DESCRIPTION OF THE PREFERRED EMBODIMENTS

Figures 8, 9:
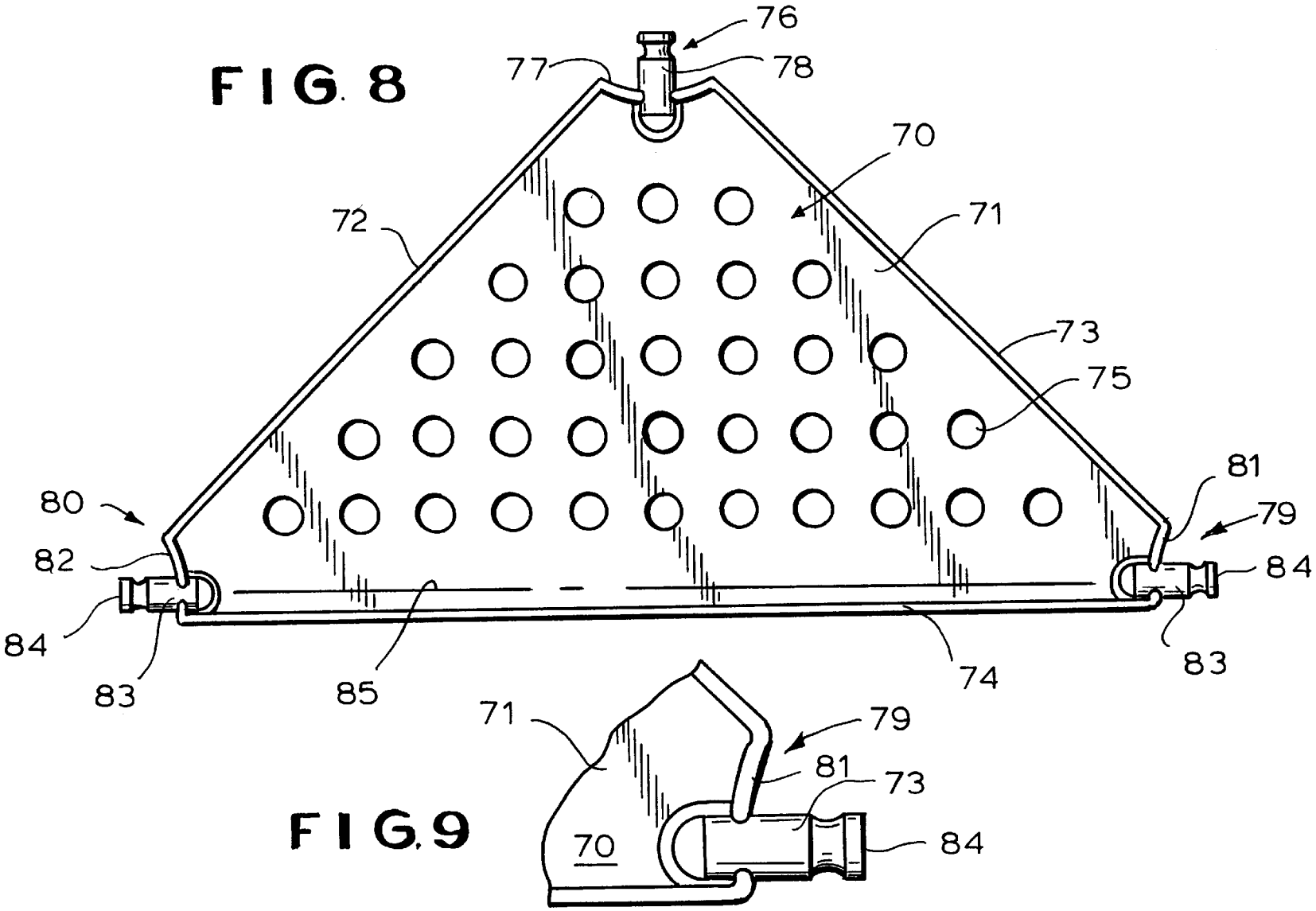
FIG. 8 is a plan view of a triangular panel according to the invention.
FIG. 9 is an enlarged fragmentary view illustrating details of a corner region of the panel of FIG. 7.

Referring now to the drawing, and initially to FIGS. 1–14 thereof, a representative panel of square configuration is shown in FIG. 1, being designated generally by the reference numeral 20. The panel includes a body portion 21 of thin, flat form. The panel 20 advantageously is formed by injection molding, using a structural plastic material, such as polypropylene, which has adequate strength and integrity for the usage intended, and some degree of resilience and flexibility. In one advantageous commercial form, the panel 20 is around 5 ½ inches on a side and, in the center portion 21, has a thickness on the order of 0.60 inch. Typically, the body 21 of the panel is formed with a plurality of through openings 22, primarily for aesthetic purposes, as well as to reduce weight and material.

The four side edges of the panel 20 typically are straight and are defined by integrally molded edge flanges 23–26. These edge flanges extend from both sides of the panel body 21 and serve to rigidify the panel and to blunt its outer edges. The edge flanges 23–26 may have a typical width of about 0.150 inch.

As shown in FIG. 1, the four edges of the square panel 20 are attenuated, and corner areas of the panel are defined by concave arcuate corner edge flanges 27, 30. The arcuate corners are arranged for cooperative association with connector elements of a commercial K'NEX construction toy set, as will appear more fully hereinafter, and are contoured accordingly, preferably to have a radius of about 0.79 inch from a center point located along a diagonal axis 31 of the square panel configuration.

In each of the corner regions of the panel 20 there is provided an integrally molded, outwardly extending rod tip element 32 of a size and shape to enable cooperative association and assembly in a skeletal structure formed with parts of a K'NEX construction toy set, generally as described in the before mentioned United States patents.

Referring at this time to FIGS. 12–14, showing features of existing K'NEX construction toy sets, the reference numeral 40 designates generally one advantageous form of molded plastic connector element used in such toy sets. The connector element has a central hub 41 surrounded by a plurality of pairs of gripping arms 42, 43 forming rod-receiving sockets 44 aligned along radial axes extending from the hub and angularly spaced from each other at a 45° angle. The respective gripping arms 42, 43 are mounted in cantilever fashion from a base wall 45 and extend outward therefrom. Outer portions of the gripping arms are formed with generally cylindrical grooves 46, 47 arranged concentrically with a radial socket axis 48. Adjacent the grooved outer portions 46, 47 are transversely disposed inwardly projecting ribs 49, which are spaced a short distance outward from the base wall 45 of the socket.

Typically, the connectors 40 are provided in a variety of configurations, having anywhere from one to eight sockets on a single connector part. In addition, as described in U.S. Pat. No. 5,137,486, connectors can be designed to be associated as multi-part assemblies, with gripping sockets radiating in more than one plane.

The described construction toy sets also include a plurality of rod elements arranged to be assembled with the connector elements to form coherent, skeletal structures. Desirably, the rods are provided in a graduated series of lengths, according to a schedule described more fully in U.S. Pat. No. 5,199,919, enabling rectangular and triangular structures to be easily assembled in graduated sizes. As described more fully in the aforementioned U.S. patents, the rod elements 50 (FIG. 14) desirably include a central section 51 of predetermined length and preferably of an X-shaped cross section, having a rod tip section 52 at each end. Each rod tip section comprises a generally cylindrical portion 53, an annular groove 54 and an end flange 55. The cylindrical portions 53 are adapted for lateral snap-fit assembly into a position between a pair of gripping arms 42, 43. When thus assembled, the cylindrical portions 53 are firmly gripped within the grooved outer portions 46, 47 of the gripping arms, which serve to position the rod element 50 in alignment with the socket axis 48.

During and following the lateral snap-fit assembly, the transverse ribs 49, are received in the annular groove 54 of the rod tip section, in the manner shown in FIG. 14, locking the rod element 50 against axial movement relative to the connector element. To particular advantage, the transverse ribs 49 are offset slightly in the direction of the base wall 45, in relation to the position of the annular groove 54 such that, after lateral snap-fit assembly, the end wall 56 of the rod tip section is urged firmly against the base wall 45 to stabilize and rigidify the structure.

Referring again to FIGS. 1–3 of the drawing, the several rod tip elements 32 incorporated into the panel structure correspond in size, shape and in other respects to the rod tip sections 52 of the regular rod elements 50 as shown in FIG. 14. Each of the rod tip elements 32 is provided with a cylindrical portion 60, an annular groove 61, and an end flange 62. These elements correspond in size and shape respectively to the cylindrical portion 53, the annular groove 54 and the end flange 55 of the regular rod elements 50 shown in FIG. 14. The rod tip elements 32 of the panels are molded integrally therewith, preferably symmetrically with respect to the central plane of the panel body 21. In this respect, each of the rod tip portions 32 includes a root portion 63 extending inwardly of the corner edge bead 28 and being tapered into the body portion 21 as indicated at 64 in FIG. 3.

In the form of the panel shown in FIG. 1, the rod tip elements 32 are arranged in spaced apart pairs, aligned along the diagonal axis 31 of the square panel. In addition, the distance between the end faces 65 of an opposed pair of rod tip elements equals the length of a given rod of a graduated set thereof included in a standard K'NEX construction toy set. Accordingly, a diagonally opposed pair of rod tip elements provided in opposite corners of the panel 20 can be installed in a skeletal structure of components of a K'NEX construction toy set essentially in the same manner as a rod of corresponding length. When thus assembled, the panel will serve to strengthen and rigidify the structure in substantially the same manner as a corresponding rod, as well as to function in a primary context as a panel.

In the illustrated and preferred form of the invention shown in FIG. 1, the rod tip elements 32 at each corner region of the panel are confined substantially within the overall square outline of the panel. Thus, if the respective side edge flanges 23–26 are extended by imaginary lines to their points of intersection, substantially as shown at the upper right in FIG. 1, the rod tip elements are shown to be substantially contained within the area bounded by such edge extensions.

FIGS. 5, 6 and 7 illustrate forms of square panels, similar to that shown in FIG. 1, but of successively smaller sizes. In this respect, each of the smaller panels includes a panel body 21*a*, 21*b*, 21*c* of successively smaller sizes. Rod tip elements 32*a–c* are arranged in aligned pairs along the diagonals of the respective square panels, with the end-face-to-end-face distance between an aligned pair of rod tip elements corresponding to the length of a correspondingly sized rod of the graduated series thereof in a K'NEX construction set.

As in the case of the panel of FIG. 1, the edges of the respective panels 21*a*–21*c* are defined by edge flanges 23–26*a*–*c* and convexly arcuate corner flanges 27–30*a*–*c*.

Although the panel bodies 21*a*–*c* are of progressively smaller size, it will be noted that the rod tip elements 32*a*–*c* and the arcuate corner flanges 27–30*a*–*c* are identical in size to the corresponding elements of the panel shown in FIG. 1. This is necessary because the rod tip elements 32*a*–*c* are required to be assembled with the same connectors as the larger panels shown in FIG. 1, and the corner contours must interfit with the connectors in the same manner.

With reference now to FIG. 8 of the drawings, there is shown a panel 70 of triangular configuration, comprised of a triangular panel body 71 bounded by edge flanges 72–74. The construction of the panel body 71 and edge flanges 72–74 is in general similar to that of the panel shown in FIG. 1. The panel body can be provided with a plurality of openings 75 for aesthetic purposes and to reduce weight and material.

In a preferred and advantageous form of the triangular panel 70, the shape of the triangle is a right isosceles triangle in which the edges 72, 73 are of equal length and oriented at 90° to form sides of the triangle and the edge 74 forms a base and is oriented at angles of 45° with respect to the edges 72, 73.

At the apex 76 of the triangle there is an concave, arcuate edge flange 77 and a rod tip element 78. The flange 77 and rod tip element 78 are of the same form and dimensions as the corresponding corner flange and rod tip elements of the before described square panel units 20, with the axis of the rod tip element 78 bisecting the 90° angle between the side edge flanges 72, 73. The rod tip element is arranged for lateral snap-fit assembly with a standard connector element, as heretofore described with respect to the square panels.

At the base corners 79, 80, concave arcuate flanges 81, 82 are provided to define the corner areas. Since these corner areas are formed at an angle of 45°, instead of 90° in the case of previously described corner configurations, the corner flanges are of shorter length, but are of the same radius as the corner flanges previously described to accommodate interfitting with standard connector parts. In the case of the base corners 79, 80, rod tip elements 83 are provided in an aligned pair, with the spacing between end faces 84 thereof corresponding to the length of a standard rod of the construction set.

In the case of the triangular panel configuration, in the form specifically illustrated herein, the rod tip elements 78, 83 are substantially confined within areas bounded by extensions of the edge flanges 72–74.

As is evident in FIGS. 8 and 9, the aligned pair of rod tip elements 83 are disposed along the base edge 74 of the triangular panel. The axis 85 along which the rod tip elements are disposed corresponds to the diagonal of a rectangular skeletal structure such that, in an assembly incorporating the triangular panel, the aligned rod tip pair 84 functions substantially as a rod element. In this respect, however, the rod tip pair 84 need not be installed as a diagonal in a structural arrangement, but may serve as one of the rectilinear sides of a structural unit, as will appear.

Figure 16:
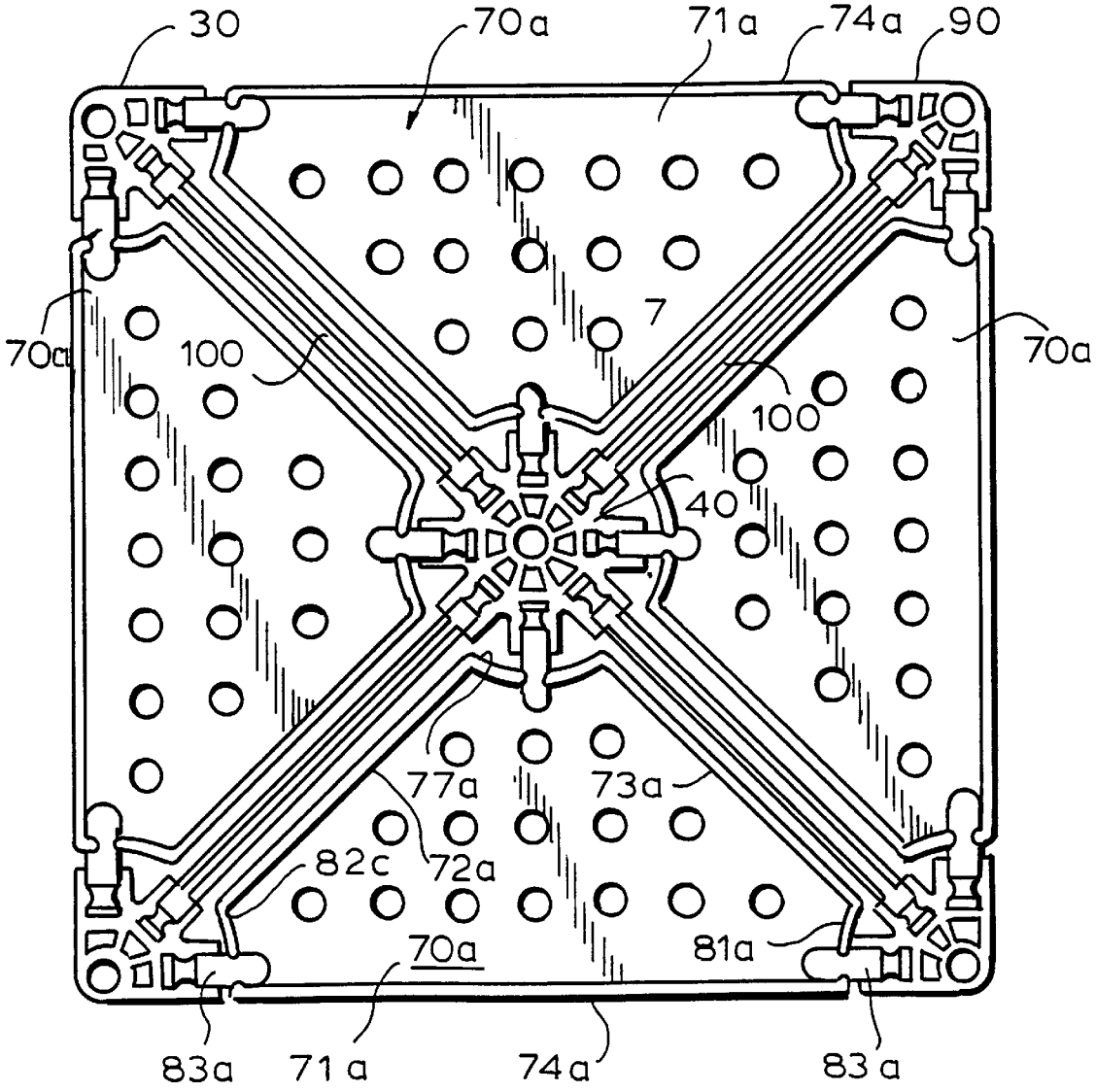

FIGS. 16, 10 and 11 illustrate triangular panels 70*a*, 70*b* and 70*c*, similar to the panel of FIG. 8, but of progressively smaller sizes. As in the case of the smaller sizes of square panel previously described, the panels 70*a*–*c* differ from the large panel 70 in terms of the size of the panel bodies 71*a*–*c* and the length of the edge flanges 72–74*a*–*c*. The arcuate corner flanges 77*a*–*c* and 81–82*a*–*c* are, however, of the same size and shape in all panel sizes, as are the rod tip elements 78*a*–*c* and 83*a*–*c*.

Figure 15:
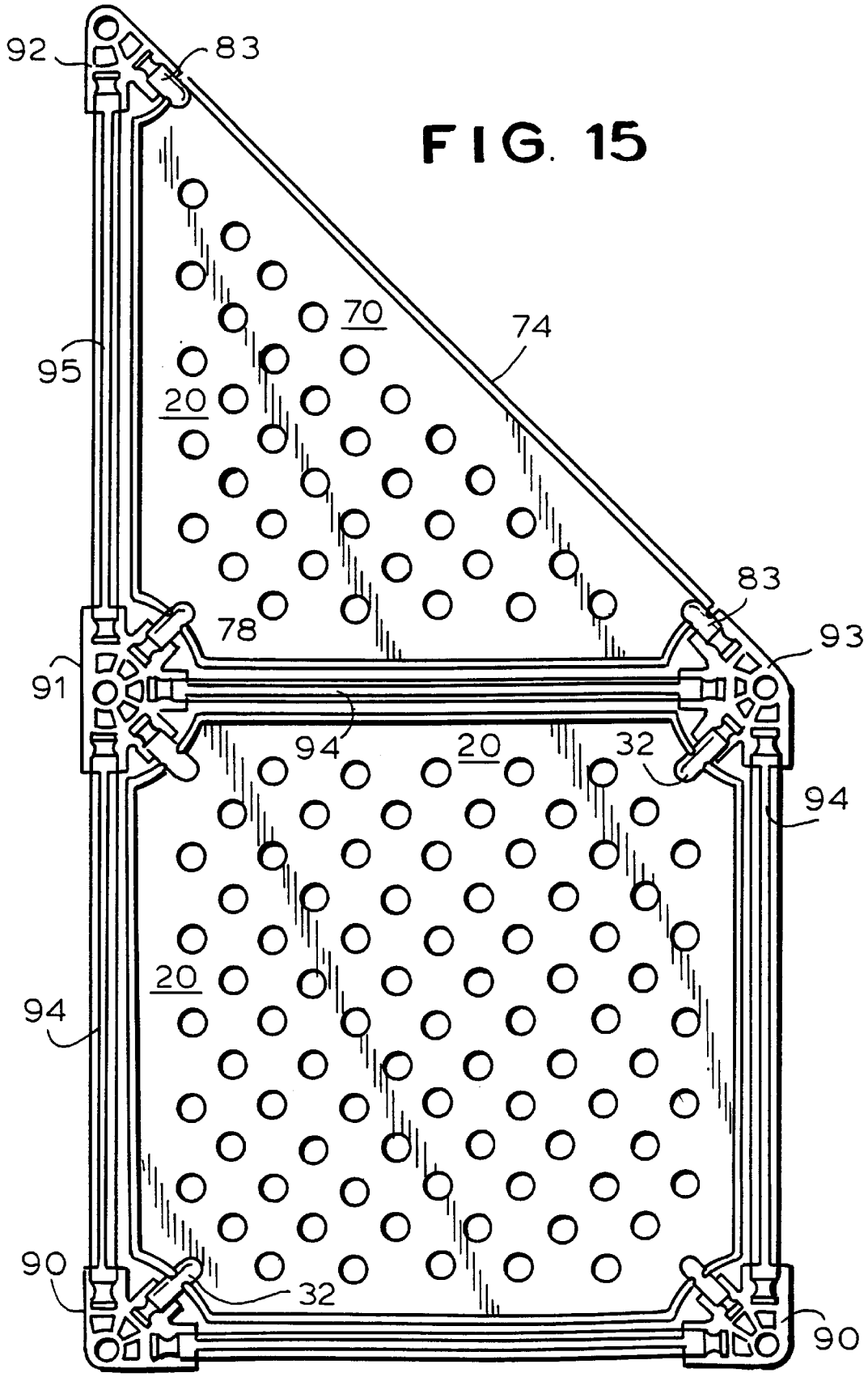
FIGS. 15–17 are plan views of assemblies of rods, connectors and panels, illustrating selected ways in which the panels of the present invention can be incorporated into skeletal structures of a K'NEX construction toy set.
Figure 17:
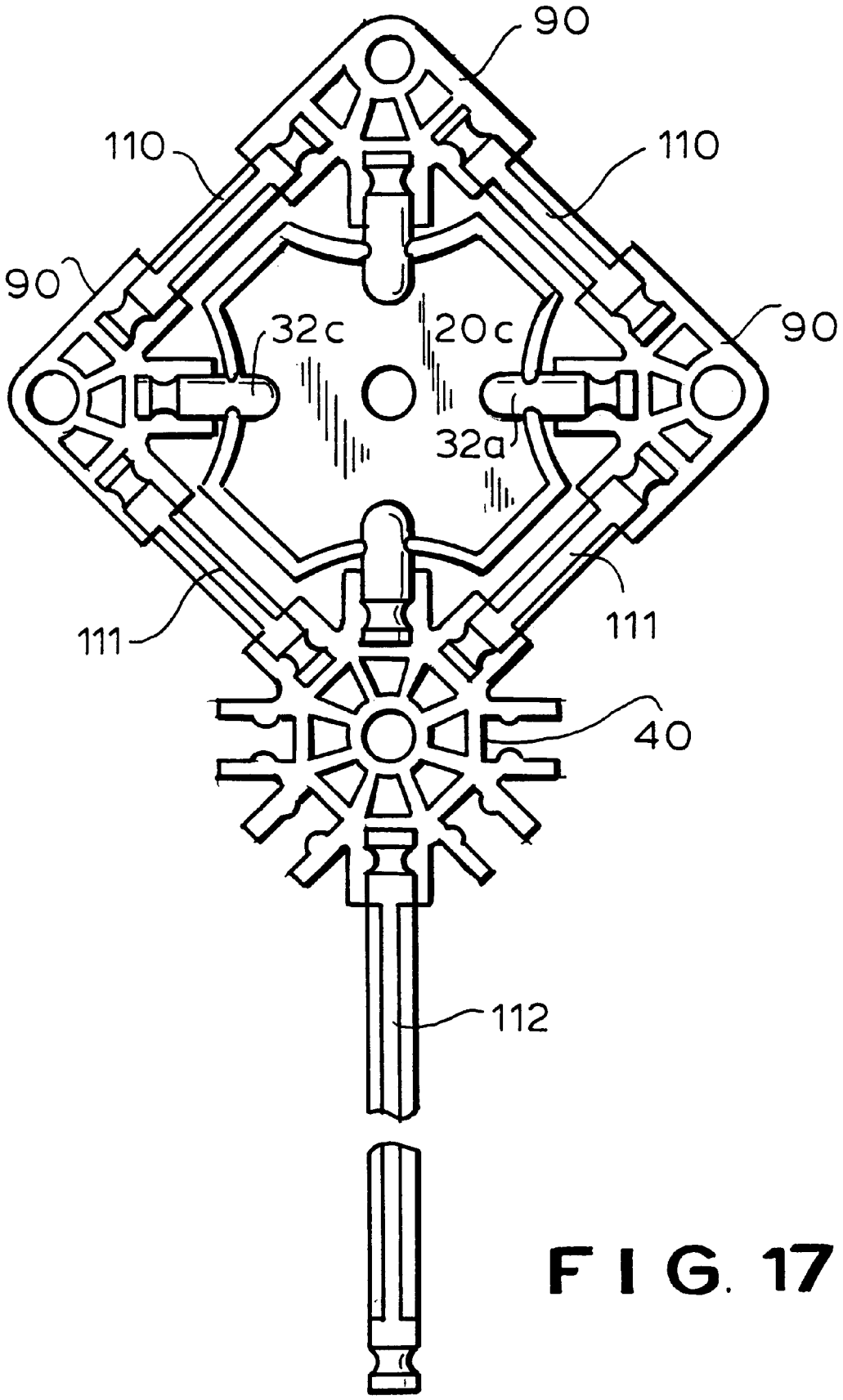

The panels of the invention can be incorporated into structures of a K'NEX construction toy set in a multitude of ways, a few which are represented in FIGS. 15–17 of the drawings. Referring initially to FIG. 15, a structure is shown which incorporates a large rectangular panel 20 and a large triangular panel 70. Included in the assembly are several different types of connectors designated generally by the reference numerals 90–93 inclusive, all of which are standard connector elements of a K'NEX toy set. The principles of design and function of all the connectors are the same as described with reference to FIGS. 12–14 hereof. The connector 90 is a three-socket connector, with two of the sockets forming a right angle and a third socket bisecting that angle. The connector 91 is a five-socket connector, with the several sockets displaced angularly from each other at 45°. The connector 92 is a two-socket connector, with the two sockets displaced at 45°. The connector 93 is a four-socket connector, with each of the sockets displaced at angles of 45°.

In the lower portion of the structure, the two three-socket connectors 90, the five-socket connector 91 and the four-socket connector 90 are joined together by four rectangularly oriented rod elements 94, forming a skeletal structure of square configuration. A square panel 20 is installed in the opening defined by the several rod elements 94 by lateral snap-fit assembly of its rod tip elements 32 in the diagonally disposed sockets of the before mentioned connectors. In addition to closing the open space defined by the rods 94, the panel 20 provides diagonal bracing for the square skeletal structure to significantly strengthen the structure, as will be understood.

In the upper portion of the structure shown in FIG. 15, the uppermost rod 94, in conjunction with a vertically oriented rod 95 forms an L-shaped skeletal structure which is completed, in the illustration, by the installation of a triangular panel 70. The aligned pair of rod tip elements 83 of the panel is assembled with aligned sockets of the connectors 92, 83, and the central rod tip element 78 of the triangular panel is installed in a socket of the connector 91. Along the bottom and vertical edges, the triangular panel 70 cooperates with rod elements 94, 95. Along the diagonal of the structure, however, the base edge 74 of the triangular panel serves in place of a rod element to complete and rigidify the structure.

In the structure of FIG. 16, a plurality of four medium size panel elements 70*a* are assembled together with a central eight-socket connector 40 and four right angle, three-socket connectors 90 to form a square structure. In the illustration of FIG. 16, four rod elements 100 extend radially from the central connector 40 to intermediate sockets of the right angle connectors 90 to impart additional strength and structure to the assembly. However, the assembly are of panels 70*a* and connectors 40, 90 in themselves form a rigid structural arrangement.

In the structure of FIG. 17, a small rectangular panel 20*c* is assembled together with three right angle connectors 90 at three corners and an eight-socket connector 40 at the fourth corner. The outer, right angularly disposed sockets of adjacent connectors 90 are joined by installed rod elements 110, and the right angle connectors are joined with two of the right angularly disposed sockets of the connector 40 by means of similar rod elements identified by the numeral 111, to form a skeletal structure with a square opening. A small panel element 20*c* is installed in that opening, with its rod tip elements 32*c* being installed in the intermediate sockets of the various connectors, with aligned pairs of the rod tip elements 32*a* connected as diagonals in the square structure. The eight socket connector 40 at one corner has a number of unused socket locations which can be utilized for the installation of other elements, such as the rod element 112, for incorporation of the panel-containing structure into larger and more complex assemblies.

As will be readily apparent, the several panels illustrated herein can be incorporated in a multitude of ways in skeletal structures formed with rods and connectors of a standard K'NEX construction toy set. The form and structure of the panels is such that they may be employed in a load-bearing capacity or in a purely decorative capacity, or both, according to the imagination or creativity of the designer. Additionally, while only square and triangular panels have been illustrated herein, it is evident that panels may be formed of a wide variety of polygonal configurations, including but not limited to rectangular, trapezoidal and octagonal.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A panel system in combination with a construction toy set, where the construction toy set comprises a plurality of connector elements, each formed of a resilient structural plastic material and comprising a plurality of radially disposed open-sided sockets, each said socket comprising a spaced-apart pair of gripping arms arranged symmetrically with respect to a radially extending axis, outer portions of said gripping arms being formed with axially extending opposed grooves arranged symmetrically with respect to said axis, portions of said gripping arms inward of and adjacent to said axially extending grooves being formed with opposed ribs disposed transversely of said axis and projecting into the space between said gripping arms, said construction toy set further comprising a plurality of rod elements of predetermined lengths provided at opposite ends thereof with integral rod tip sections comprising generally cylindrical portions sized and shaped for lateral snap-fit assembly between grooved portions of an opposed pair of gripping arms of a connector element, said rod tip sections further having, closely adjacent an end extremity thereof, an annular groove defining an end flange sized and shaped for lateral reception between opposed ribs of a pair of gripping arms to lock said rods against movement relative to said gripping arms in the direction of said axis, and said panel system comprises (a) a panel member formed of a one-piece molding of structural plastic material, said panel member including:

(i) a thin, flat plate-like central portion defining a panel plane and bounded by at least three side edges, which side edges define panel corner regions, (ii) integral rod tip elements at each corner region projecting outward from said corner regions and having axes lying substantially in said panel plane, (iii) each said rod tip element having a configuration corresponding to the configuration of said rod tip sections and being sized and shaped for lateral snap-fit assembly between an opposed pair of gripping arms of a connector element, (b) first and second ones of said connector elements being attached to first and second ones of said rod tip elements of said panel member, respectively, and (c) one of said rod elements being connected between both said first and second connector elements.

2. A panel system as in claim 1, further comprising (a) connector elements connected to each rod tip element of said panel member, (b) each connector element connected to said panel member being interconnected to two other connector elements connected to said panel member by one of said rod elements.

3. A panel according to claim 1, wherein (a) said panel has an integrally molded edge rib extending substantially entirely around the peripheral edges of said panel.

4. A panel according to claim 1, wherein (a) each of said panel corner regions is defined in part by a corner edge of arcuate contour, and (b) said panel rod tip elements extend outward from said arcuate corner edges.

5. A panel according to claim 1, wherein (a) said side edges are generally straight, (b) extensions of adjacent side edges of said panel intersect outside the area of said panel central portion, and (c) said panel rod tip elements are contained substantially within areas bounded by said arcuate edge contours and said side edge extensions.

6. A panel according to claim 1, wherein (a) said panel rod tip elements are joined integrally with root portions extending inward of said panel central portion.

7. A panel according to claim 1, wherein (a) at least two adjacent ones of said panel side edges are oriented at right angles and define a right angle corner, and (b) the rod tip element located at said right angle corner is oriented to bisect said right angle.

8. A panel according to claim 7, wherein (a) said panel is defined in rectangular configuration by four generally straight side edges with adjacent side edges oriented at right angles, and (b) each of said rod tip elements is oriented to bisect the angle of the corner at which it is located.

9. A panel according to claim 1, wherein (a) rod tip elements at opposite ends of one side edge are disposed generally parallel to said side edge.

10. A panel according to claim 9, wherein (a) said panel is defined in triangular configuration by said one side edge and by second and third side edges forming a right angle corner, (b) the rod tip element located at said right angle corner being oriented to bisect the angle of said corner.

11. A panel according to claim 1, wherein (a) at least two of said rod tip elements being arranged as an aligned pair.

12. A panel according to claim 11, wherein (a) said panel is formed in the configuration of a square, and (b) pairs of said rod tip elements are aligned along diagonals of said square.

13. A panel according to claim 11, wherein (a) said panel is formed in the configuration of a right isosceles triangle, and (b) two of said rod tip elements are arranged in an aligned pair along an edge forming the base of said triangle.

* * * * *